US009516429B2

(12) United States Patent
Kwon et al.

(10) Patent No.: US 9,516,429 B2
(45) Date of Patent: Dec. 6, 2016

(54) HEARING AID AND METHOD FOR CONTROLLING HEARING AID

(71) Applicant: Samsung Electronics Co., Ltd., Suwon-si (KR)

(72) Inventors: See Youn Kwon, Seoul (KR); Dong Wook Kim, Seoul (KR); Jong Min Choi, Seoul (KR); Jong Hee Han, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 162 days.

(21) Appl. No.: 14/077,601

(22) Filed: Nov. 12, 2013

(65) Prior Publication Data

US 2015/0010177 A1 Jan. 8, 2015

(30) Foreign Application Priority Data

Jul. 2, 2013 (KR) ..... 10-2013-0077076

(51) Int. Cl.
*H04R 25/00* (2006.01)

(52) U.S. Cl.
CPC ..... *H04R 25/00* (2013.01); *H04R 2225/61* (2013.01)

(58) Field of Classification Search
CPC ..... H04R 2499/11; H04R 1/1041; H04R 2225/61; H04R 25/30; H04R 25/70; H04R 2430/01; H04R 29/00; H04R 2201/109; H04R 25/305; G10K 2210/1081; H04S 7/303; H04S 7/302; G06F 3/017; G06F 3/012; G06F 1/3231; A61B 5/11
USPC ..... 381/74, 56, 314–315, 60, 107; 348/164, 348/169
See application file for complete search history.

(56) References Cited

U.S. PATENT DOCUMENTS

| | | | | |
|---|---|---|---|---|
| 2005/0094834 | A1 | 5/2005 | Chalupper | |
| 2011/0044483 | A1 | 2/2011 | Edgar | |
| 2011/0091059 | A1 | 4/2011 | Sacha | |
| 2011/0200213 | A1* | 8/2011 | Knox | H04R 25/505 381/314 |
| 2012/0119987 | A1* | 5/2012 | Im et al. | 345/156 |
| 2014/0023214 | A1* | 1/2014 | Edgar | 381/314 |

FOREIGN PATENT DOCUMENTS

| | | | |
|---|---|---|---|
| JP | 09-182193 | A | 7/1997 |
| JP | 2006-033853 | A | 2/2006 |
| JP | 2012-514392 | A | 6/2012 |
| KR | 10-2008-0014346 | A | 2/2008 |
| KR | 10-2009-0102127 | A | 9/2009 |
| KR | 10-2012-0015614 | A | 2/2012 |
| WO | WO 02/28143 | A2 | 4/2002 |

* cited by examiner

*Primary Examiner* — Paul S Kim
*Assistant Examiner* — Norman Yu
(74) *Attorney, Agent, or Firm* — NSIP Law

(57) ABSTRACT

A hearing aid and a method of controlling a hearing aid are provided. The hearing aid includes a sensor configured to obtain sensor data corresponding to a user movement, a pattern identifying unit configured to identify a pattern in the sensor data, and a control unit configured to determine whether a pattern identifier is present in the pattern of the sensor data and to control operation of the hearing aid.

20 Claims, 6 Drawing Sheets

HEARING AID AND METHOD FOR CONTROLLING HEARING AID

CROSS-REFERENCE TO RELATED APPLICATION(S)

This application claims the benefit under 35 USC §119(a) of Korean Patent Application No. 10-2013-0077076 filed on Jul. 2, 2013, in the Korean Intellectual Property Office, the entire disclosure of which is incorporated herein by reference for all purposes.

BACKGROUND

1. Field

The following description relates to a hearing aid and a method for controlling a hearing aid.

2. Description of Related Art

A hearing aid receives a sound wave through a microphone, and outputs the received sound wave after processing and amplifying the sound wave. With the development of integrated circuits (ICs) and hearing aid fitting technology, some hearing aids are capable of providing an amount of gain and a type of output that are appropriate for a type and degree of hearing loss. Further, the sizes of hearing aids have been reduced.

Hearing aids are produced in various forms, such as a glasses type hearing aid for mounting to a glasses frame, a behind-the-ear (BTE) type hearing aid for wearing on an ear, and a completely-in-canal (CIC) type hearing aid for mounting inside an ear. Recently, the hearing aids provide, not only a basic function of supplementing a hearing ability of a user, but also various other functions such as Bluetooth connection to other devices, noise removal, sound impulse smoothing, and the like.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, there is provided a hearing aid including: a sensor configured to obtain sensor data corresponding to a user movement; a pattern identifying unit configured to identify a pattern in the sensor data; and a control unit configured to determine whether a pattern identifier is present or absent in the pattern of the sensor data and to control the hearing aid.

In response to a determination that a pattern identifier is present in the pattern of the sensor data, the control unit may be configured to initiate an operation of the hearing aid that corresponds to the pattern identifier.

The control unit may be configured to confirm whether to perform the operation of the hearing aid that corresponds to the pattern identifier based on an input of another user movement.

The operation of the hearing aid may include at least one selected from the group consisting of: mode change, full band gain control, gain control per frequency band, binaural hearing control, directivity control, connection control with other device, and parameter setting.

The control unit may be configured to activate the sensor to obtain the sensor data in response to receiving a user input through an interface.

The user input may include at least one selected from the group consisting of: a button press, a touch input, and a sound input.

The control unit may be configured to output guide information indicating an operation corresponding to the pattern identifier in response to a determination that a pattern identifier is present in the pattern of the sensor data.

The sensor data may be movement data obtained from the sensor or from a motion sensor in a remote control of the hearing aid.

In another general aspect, there is provided a hearing aid including: a sensor configured to obtain sensor data corresponding to a user movement; a pattern information storage unit configured to store predetermined patterns; and a control unit configured to determine presence or absence of a pattern identifier in the sensor data based on the predetermined patterns and to control the hearing aid.

The control unit may be configured to determine the presence or the absence of the pattern identifier by comparing a pattern of the sensor data to the predetermined patterns stored in the pattern information storage unit.

In response to a determination that a pattern identifier is absent, the control unit may be configured to output guide information for inputting another user movement to the sensor.

In response to a determination that a pattern identifier is present, the control unit may be configured to initiate an operation of the hearing aid that corresponds to the pattern identifier.

In another general aspect, there is provided a method for controlling a hearing aid, the method involving: obtaining sensor data by detecting a user movement; determining whether a pattern identifier is present or absent in the sensor data; and controlling the hearing aid based on the presence or the absence of the pattern identifier.

The determining may involve determining the presence or the absence of the pattern identifier by comparing a pattern of the sensor data to predetermined patterns stored in a pattern information storage unit.

In response to the pattern identifier being present, the controlling may involve performing an operation of the hearing aid that corresponds to the pattern identifier.

The obtaining may involve: receiving a user input comprising a movement pattern through an interface; and outputting sensor data by detecting the user movement from a time at which the user input is received.

The general aspect of the method may further involve: determining whether a user setting mode is selected; identifying an operation of the hearing aid selected by the user when the user setting mode is selected; and generating pattern information corresponding to the selected operation of the hearing aid based on the user movement.

The obtaining may involve: receiving a user input through an interface; and outputting sensor data generated based on the user movement from a time at which the user input is received.

The operation of the hearing aid may include at least one selected from the group consisting of: mode change, full band gain control, gain control per frequency band, binaural hearing control, directivity control, connection control with other device, and parameter setting.

Other features and aspects will be apparent from the following detailed description, the drawings, and the claims.

Figure 1:
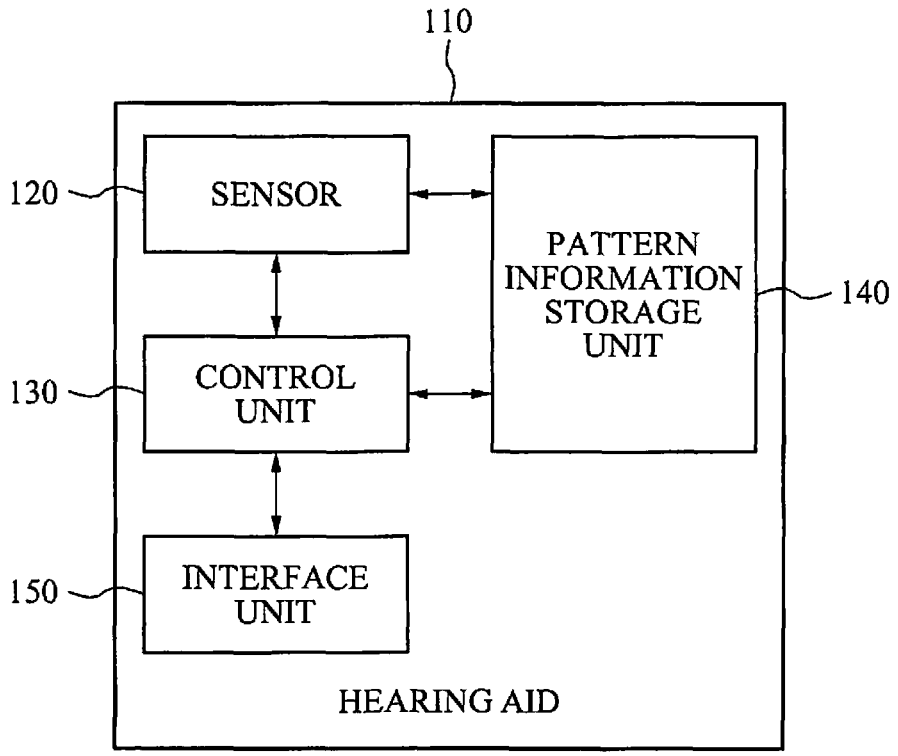
FIG. 1 is a diagram illustrating an example of a hearing aid.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the systems, apparatuses and/or methods described herein will be apparent to one of ordinary skill in the art. The progression of processing steps and/or operations described is an example; however, the sequence of and/or operations is not limited to that set forth herein and may be changed as is known in the art, with the exception of steps and/or operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

As described above, recently, the hearing aids provide, not only a basic function of supplementing a hearing ability of a user, but also various other functions such as Bluetooth connection to other devices, noise removal, sound impulse smoothing, and the like. According to the diversification of functions of the hearing aid, it is desirable to develop a user interface (UI) that allows a user to control the various functions of the hearing aid without increasing the size of the hearing aid.

FIG. 1 illustrates an example of a hearing aid 110.

The hearing aid 110 may allow a user to control various aspects of operation of the hearing aid 110 based on a movement of the user. The movement of the user may be detected by the hearing aid 110 to determine the intent of the user. For example, while wearing the hearing aid 110, the user may nod his or her head up and down. The hearing aid 110 may detect the head movement of the user and perform a function that corresponds to the movement pattern of the head. The movement patterns that initiate a specific function of the hearing aid 110 may be determined in advance. In another example, the user may shake his or her arm up and down while holding a remote control of the hearing aid 110 in his or her hand. The hearing aid 110 may detect the arm movement of the user and interpret the movement as a command to perform a function that corresponds to a movement pattern of the arm.

Due to the limited size of hearing aids, a number of buttons that may be provided on hearing aids to control the operation of hearing aids is limited. Further, while a hearing aid is worn by a user, the hearing aid may be placed on a rear side of the head or may be placed inside an ear. Thus, attempts to access buttons located on such a hearing aid may be inconvenient or impossible and may cause erroneous operation of the hearing aid. Since the hearing aid 110 suggested herein is capable of controlling the functions based on a movement pattern of the user, an interface that is intuitive and convenient for the user may be designed to allow the user to control the hearing aid 110. Also, by minimizing the number of buttons provided on the hearing aid 110, the hearing aid 110 may be reduced in size.

Referring to the example illustrated in FIG. 1, the hearing aid 110 includes a sensor 120, a control unit 130, a pattern information storage unit 140, and an interface unit 150.

The sensor 120 may detect a user movement and may output sensor data to the control unit 130 or the pattern information storage unit 140. For example, while wearing the hearing aid 110 on his or her ear, the user may move his or her head. The sensor 120 may detect the head movement and output the sensor data to the control unit 130. The sensor 120 may include a motion sensor such as an acceleration sensor, a gyro sensor or a combination thereof. The sensor data may refer to data output from the motion sensor. The sensor 120 may detect the presence of a movement, a movement direction, a rotational movement, a translational movement, a movement speed, a degree of tilting, a change in acceleration, and the like.

The control unit 130 may control the operation of the sensor 120. For example, the control unit 130 may transmit a control signal to the sensor 120, thereby triggering the sensor 120 to output the sensor data or to stop the operation. When the control unit 130 receives a user input for operating the hearing aid 110 through the interface unit 150, the control unit 130 may transmit the control signal to the sensor 120 to enable the sensor 120 to output the sensor data.

The user input may include a button press, a touch input, a particular sound input and the like. For example, the control unit 130 may enable the sensor 120 to operate in response to: a particular button of the hearing aid 110 or a particular button of the remote control of the hearing aid 110 being pressed; the touch input of the user being detected by a touch sensor; or a teeth chattering sound of a particular pattern is received through a microphone. The control unit 130 may stop the operation of the sensor 120 when the sensor 120 receives another user input after outputting the sensor data. In another example, the control unit 130 may control the sensor 120 to automatically stop the operation when the sensor 120 has not detected any movement for a predetermined time.

The control unit 130 may identify a pattern of the sensor data that corresponds to the movement of the user. The control unit 130 may analyze the sensor data to identify a pattern of the sensor data output from the time when the operation of the sensor 120 has been initiated to the time when the operation of the sensor 120 has been stopped. The control unit 130 may identify the pattern of the sensor data according to the movement of the user from the time at which the user input has been received, and compare the pattern to predetermined patterns stored in the pattern information storage unit 140. The predetermined patterns may include a pattern set by the user in advance. The pattern information storage unit 140 may include the predetermined patterns corresponding to operations of the hearing aid 110.

The pattern information storage unit 140 may include a non-transitory computer readable media or a computer readable memory.

The control unit 130 may determine whether a pattern identifier that corresponds to one of the predetermined patterns is present in the sensor data. The predetermined patterns may include pattern identifiers, which indicate particular patterns of movement that correspond to particular operations of the hearing aid 110 that a user wants to initiate. The control unit 130 may determine whether a pattern identifier has a same or similar pattern to the pattern of the sensor data from the sensor 120 to determine whether a pattern identifier is present in the sensor data. The control unit 130 may calculate similarity between the pattern of the sensor data obtained from the movement of the user and the patterns of the pattern identifiers, and determine whether a pattern identifier corresponds to the pattern of the sensor data based on the calculated similarity. The control unit 130 may estimate the movement of the user by comparing the pattern of the sensor data with the patterns of the pattern identifier. When a pattern identifier that corresponds to the pattern of the sensor data is identified, the control unit 130 may perform an operation of the hearing aid 110 as indicated by the pattern identifier.

According to the pattern identifiers, the control unit 130 may perform operations such as mode change for the hearing aid 110, full band gain control, gain control per frequency band, binaural hearing control, directivity control, connection control with respect to other devices, and parameter setting. In this example, the mode change refers to change to a noise removal mode, an optimal mode according to situations such as a phone talking situation, a meeting situation, a public place situation, and the like, or change to a preset mode preset by the user. The gain control per frequency band refers to control of a gain according to frequency bands of a signal input to the hearing aid 110. The binaural hearing control refers to control of operations of the hearing aids 110 that are worn on both ears of the user. The parameter setting refers to fitting of parameters of the hearing aid 110 to fit hearing loss characteristics of the user.

According to an example, the pattern of the sensor data obtained from a head nodding movement of the user may correspond to a pattern identifier indicating the directivity control. In response to detecting such a pattern identifier, the control unit 130 may perform an operation of controlling the directivity of the hearing aid 110. Accordingly, the user may initiate the operation of controlling the directivity of the hearing aid 110 by nodding his or her head up and down while wearing the hearing aid 110. During the directivity control, the user may control the directivity of the hearing aid 110 by moving his or her head in a desired direction of hearing.

According to another example, the pattern of the sensor data obtained from a movement of the user corresponding to shaking of the head left and right may correspond to a pattern identifier indicating the connection control with respect to other devices. In response, the control unit 130 may attempt establishing connection with a terminal, a multimedia device, and the like. For example, the user may have the hearing aid 110 connect with an audio player by shaking his or her head left and right.

According to still another example, the pattern of the sensor data obtained from a movement of the user of nodding the head up and down with the head turned by about 30° from the front to the left may correspond to a pattern identifier indicating the user's desire to initiate a parameter setting operation. In response to detecting such a pattern, the control unit 130 may change levels of parameters through the movement of the user.

According to an example, before the control unit 130 performs the operation corresponding to the pattern identifier, the interface unit 150 may output guide information related to the operations of the hearing aid 110. The guide information may be output in the form of a voice message. When a pattern identifier that corresponds to the parameter setting operation is present in the pattern of the sensor data, the interface unit 150 may output the guide information indicating the operation of the hearing aid 110 to the user. For example, when an operation that corresponds to a detected pattern identifier is the mode change of the hearing aid 110, the interface unit 150 may output information regarding the mode change to the user through a speaker of the hearing aid 110. The guide information indicating the operation may include inquiry information for inquiring whether to perform the operation corresponding to the pattern identifier. The user may confirm whether to perform the operation through a movement or a particular sound, for example.

According to an example, the control unit 130 may determine whether to perform an operation corresponding to a pattern identifier by detecting the user input indicating a particular movement through the sensor 120. The control unit 130 may determine a user intention by analyzing the sensor data according to the movement of the user, and determine whether to perform the operation corresponding to the pattern identifier. For example, the control unit 130 may determine an up and down movement of the head of the user as an intention of 'YES' and determine to proceed with the operation corresponding to the pattern identifier. In addition, the control unit 130 may determine a shaking of the head to the left and right as an intention of 'NO', and determine not to perform the operation corresponding to the pattern identifier.

According to another example, the control unit 130 may determine whether to perform an operation corresponding to a detected pattern identifier, based on a user input such as a whistle sound, a teeth chattering sound of a particular pattern, and the like. For example, the user may make a whistle sound to have the hearing aid 110 perform a particular operation determined based on the movement of the user, or make a teeth chattering sound of a particular pattern to have the hearing aid 110 not perform the operation. The control unit 130 may determine the user intention by analyzing a type of the sound received from the interface unit 150, and determine whether to perform the operation determined based on the movement of the user.

Figure 2:
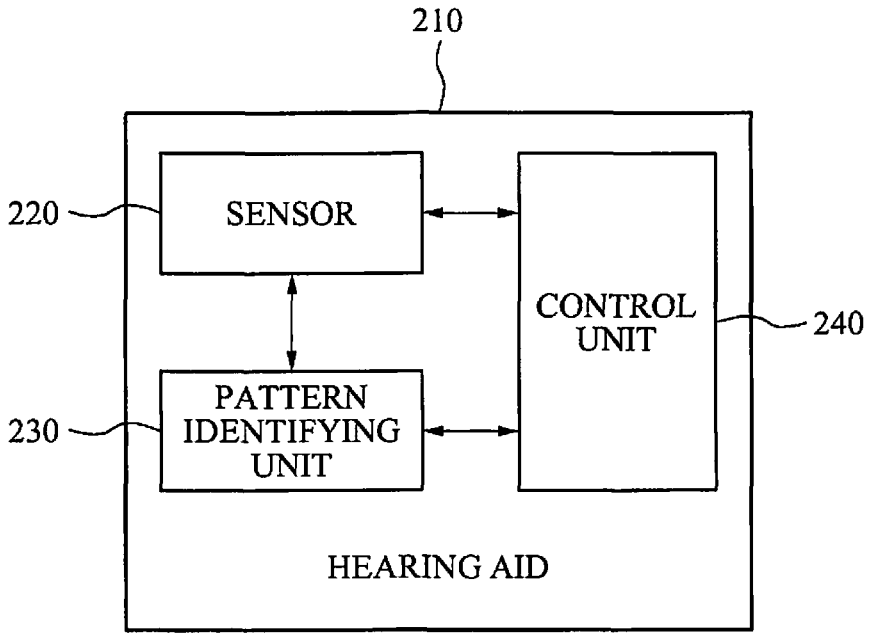
FIG. 2 is a diagram illustrating another example of a hearing aid.

FIG. 2 illustrates another example of a hearing aid 210.

The user may execute a function or operation of the hearing aid 210 corresponding to a particular movement by making the particular movement while wearing the hearing aid 210. According to an example, the user may control the full band gain control mode to be performed, by repeating a movement of turning his or her head by about 30° or more from the front to the left twice. In the full band gain control mode, the user may increase a gain of the full band by performing a movement of lifting his or her head up from the front by about 30° or more, or may decrease the gain by performing a movement of lowering his or her head down from the front by about 30° or more. Also, the user may end the full band gain control mode by repeating a movement of turning his or her head by about 30° or more from the front to the right twice. Thus, the user may control various functions of the hearing aid 210 through movements without other dedicated manipulations such as a button press.

The hearing aid 210 may determine an intention of the user by identifying the type of movement made by the user. The hearing aid 210 may control the operation of the hearing aid 210 based on the determination. For example, the hearing aid 210 may determine whether a pattern of sensor data includes a pattern identifier by comparing the pattern of the sensor data obtained during a head movement of the user to a predetermined pattern. When a pattern identifier that corresponds to the pattern of the sensor data is detected, the hearing aid 210 may perform an operation of the hearing aid 210 as indicated by the pattern identifier.

Referring to FIG. 2, the hearing aid 210 includes a sensor 220, a pattern identifying unit 230, and a control unit 240.

The sensor 220 may output sensor data by detecting a movement of the user. For example, the sensor 220 may be built into the hearing aid 210 or into a remote control of the hearing aid 210. The sensor 220 may include a motion sensor such as an acceleration sensor, a gyro sensor and the like. The sensor data may include movement data output from the motion sensor. The operation of the sensor 220 may be activated or stopped according to a signal from the control unit 240.

The pattern identifying unit 230 may identify the pattern of the sensor data output by the sensor 220. The pattern identifying unit 230 may store the sensor data from a particular time point according to the control of the control unit 240. The pattern identifying unit 230 may identify the pattern of the sensor data indicating a temporal change of the sensor data, based on the stored sensor data. The pattern identifying unit 230 may determine the type of movement made by the user based on the sensor data, by identifying a pattern of the sensor data.

The control unit 240 may activate the operation of the sensor 220 when a user inputs a user input that corresponds to a particular pattern through an interface of the hearing aid 210. The user input may include a button press, a touch input, and a particular sound input. For example, the control unit 240 may activate the sensor 220 when a button of the hearing aid 210 or a button of the remote control of the hearing aid 210 is pressed, or when a teeth chattering sound of a particular pattern is received through a microphone. When the control unit 240 receives another user input or determines that a movement of the user is absent for a predetermined time after the sensor is activated, the control unit 240 may stop the operation of the sensor 220 or activate the pattern identifying unit 230 to identify the movement pattern of the user.

The control unit 240 may control the operation of the hearing aid 210 based on the identified pattern of the sensor data. The control unit 240 may determine whether a pattern identifier that corresponds to an command is present in the sensor data, and control the operation of the hearing aid 210 based on the determination result. The control unit 240 may analyze the identified pattern of the sensor data. In the event that a pattern identifier that corresponds to a function is present in the sensor data, the control unit 240 may perform the operation of the hearing aid 210 that corresponds to the pattern identifier.

The control unit 240 may determine whether the pattern of the sensor data obtained by the sensor 220 is same or similar to a pattern identifier. When such a pattern identifier is present, the control unit 240 may perform the operation of the hearing aid 210 that corresponds to the pattern identifier. For example, according to the pattern identifiers, the control unit 240 may perform operations including mode change for the hearing aid 210, full band gain control, gain control per frequency band, binaural hearing control, directivity control, connection control with respect to other devices, and parameter setting.

According to an example, presuming that a pattern of sensor data obtained from the movement of a user in shaking the head left and right twice is equal to a pattern identifier corresponding to the switch to a noise removal mode, the control unit 240 may change the mode of the hearing aid 210 to the noise removal mode when the user shakes his or her head left and right twice.

Prior to performing the operation that corresponds to the pattern identifier, the control unit 240 may output guide information related to a result of identifying the pattern. For example, when a pattern identifier that corresponds to an operation is present in the pattern of the sensor data, the control unit 240 may output the guide information that indicates the operation that corresponds to the pattern identifier through the interface.

The guide information indicating the operation may include inquiry information for inquiring whether to perform the operation of the hearing aid 210 that corresponds to the detected movement of the user. The user may confirm or disapprove of whether to perform the operation by generating a particular sound or a particular movement. The control unit 240 may determine whether to perform the operation corresponding to the pattern identifier, based on a user input indicated by the particular sound or movement. The control unit 240 may determine a user intention by analyzing sensor data generated from the movement of the user, and determine whether to perform the operation corresponding to the pattern identifier. According to another example, the control unit 240 may determine whether to perform the operation corresponding to the pattern identifier based on the user input such as a whistle sound, a teeth chattering sound of a particular pattern, and the like. The control unit 240 may determine the user intention based on the sound identified by the microphone and determine whether to perform the operation corresponding to the pattern identifier.

When a pattern identifier is not detected in the pattern of the sensor data, the control unit 240 may output predetermined guide information through the interface. For example, when the pattern of the sensor data is absent of any pattern identifier, the control unit 240 may output guide information for guiding the user to input the movement pattern again.

Figure 3:
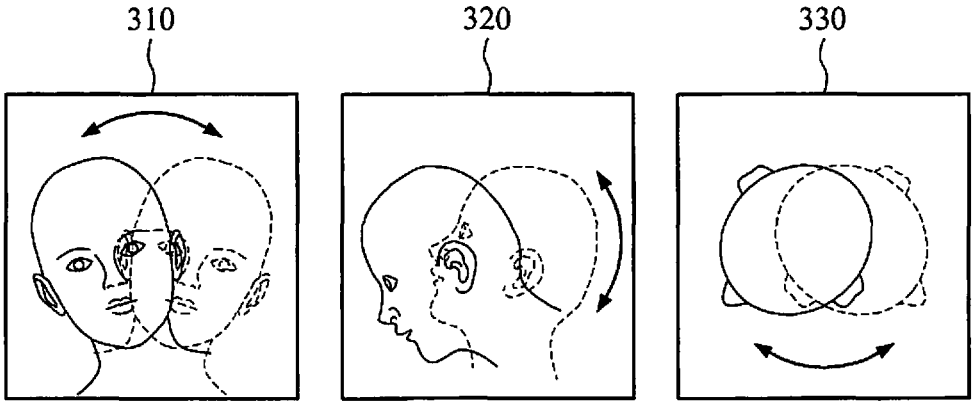
FIG. 3 is a diagram illustrating examples of various user movements.

FIG. 3 illustrates various examples of head movements of a user, as examples of user movements that the user may input to a hearing aid.

The user wearing a hearing aid may control various operations or functions of the hearing aid by making: a head movement 310 of tilting his or her head to the right and the left while facing the front, a movement 330 of nodding his or her head up and down, and a movement 330 of shaking his or her head left and right by rotating the neck region.

The hearing aid may determine a type of the movement made by the user, based on a pattern of sensor data output from a motion sensor. Based on the determination result, the hearing aid may perform an operation that corresponds to the movement of the user. The hearing aid may determine which operation to perform from a plurality of operations available for the hearing aid, by comparing predetermined patterns corresponding to the functions of the hearing aid to the pattern recognized from the sensor data.

Figure 4:
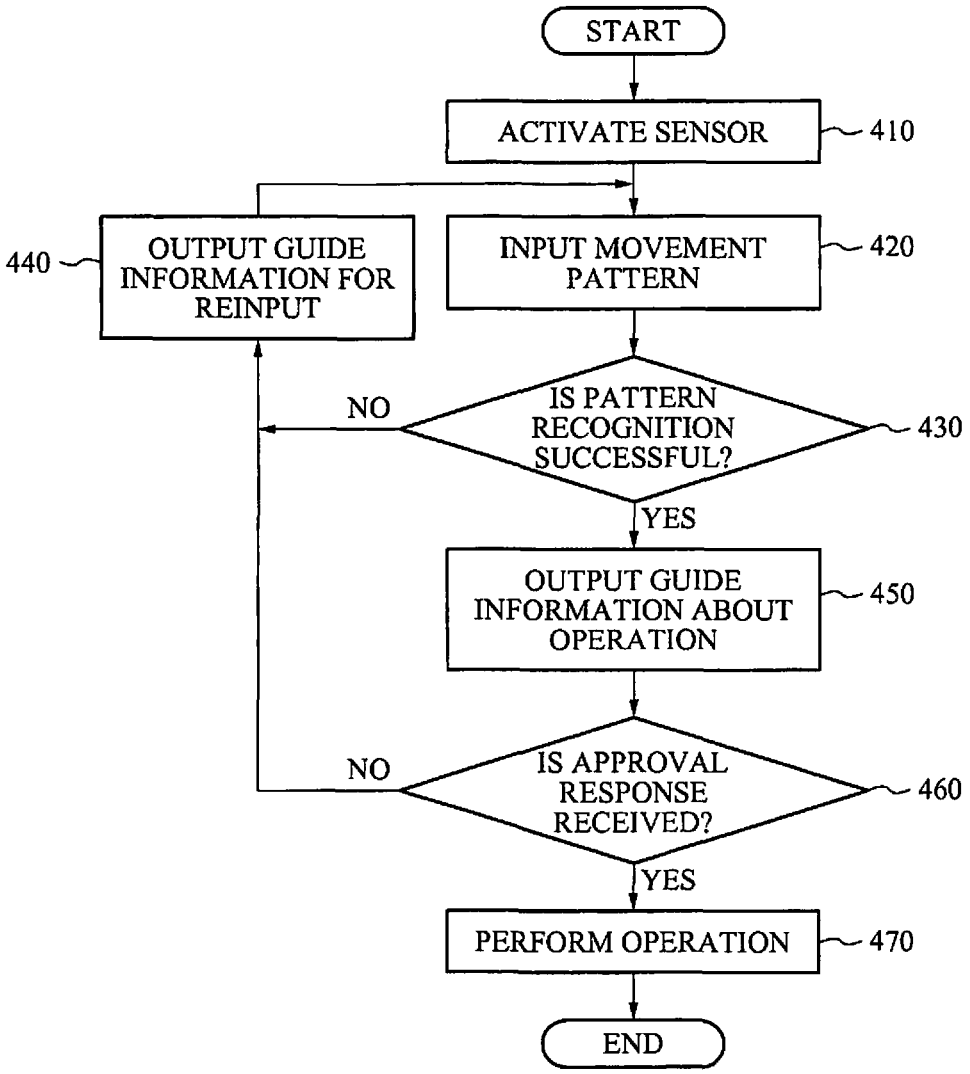
FIG. 4 is a flow chart illustrating an example of a method for controlling a hearing aid.

FIG. 4 illustrates an example of a hearing aid control method.

In operation 410, when a hearing aid receives a user input for initiating a function, the hearing aid may activate a sensor. The user input may include a button press, a touch input, and a particular sound input. For example, the hearing aid may activate the sensor to operate in response to: a particular button of the hearing aid or a button of the remote control being pressed; a detection of a touch input on a touch sensor as provided by the user; a detection of a teeth chattering sound of a particular pattern received through a microphone; a voice command given by the user comprising a predetermined word or phrase; and the like.

In operation 420, a user may input a movement pattern to the hearing aid, for example, by making a head movement. The sensor data corresponding to the movement pattern may be output from the sensor. The hearing aid may identify a movement pattern of the user from a pattern of the sensor data. The hearing aid may identify a region containing the pattern of the sensor data that corresponds to the movement pattern from when the sensor was activated to start the operation to when the sensor ends the operation.

In operation 430, the hearing aid may determine whether a pattern identifier corresponding to the identified pattern of the sensor data is present. When the pattern identifier that corresponds to an identified pattern of the sensor data is detected, the hearing aid may determine this case to be a pattern recognition success. When the pattern identifier that corresponds to the identified pattern of the sensor data is absent in the pattern of the sensor data, the hearing aid may determine this case to be a pattern recognition failure.

The hearing aid may compare the pattern of the sensor data with predetermined patterns indicated by the pattern identifiers. The predetermined patterns may include the pattern of the sensor data set by the user. For example, the hearing aid may determine whether a predetermined pattern having a range of similarity is included in the pattern of the sensor data. The hearing aid may calculate similarity between the pattern of the sensor data according to the movement of the user and the predetermined patterns, and determine the pattern identifier corresponding to the pattern of the sensor data based on the similarity.

In operation 440, when the pattern identifier corresponding to the pattern of the sensor data is absent, a pattern recognition failure has occurred. The hearing aid may output the guide information for re-input of the movement of the user. In response to the pattern recognition failure, the hearing aid may output the guide information for re-input and the guide information indicating the pattern recognition failure, together. The guide information for re-input may be provided to the user by outputting the guide information in a voice format. The user may be provided with another chance to input a movement of the user, as in operation 420.

In operation 450, the pattern identifier that corresponds to a command is present in the pattern of the sensor data, the pattern recognition was successful. In response to a successful pattern recognition, the hearing aid may output guide information related to the operation of the hearing aid that corresponds to the detected pattern identifier. The guide information may include inquiry information for inquiring whether to perform the operation that corresponds to the detected pattern identifier.

In operation 460, the hearing aid may determine whether an approval response is received from the user, by using the sensor or the microphone. The user may indicate whether to perform the operation by making a movement for approval or a particular sound. The hearing aid may determine whether to perform the operation corresponding to the predetermined pattern by identifying a type of movement detected by the sensor, or may determine whether to perform the operation corresponding to the pattern identifier by identifying a type of sound detected through the microphone.

According to an example, when the user nods his or her head up and down, the hearing aid may determine that the approval response is received. When the user shakes his or her head left and right, the hearing aid may determine that a disapproval response is received. According to another example, when the user makes a teeth chattering sound, the hearing aid may determine that the approval response is received. When the user makes a whistle sound, the hearing aid may determine that the disapproval response is received. When the disapproval response is received, the hearing aid may output the guide information for re-input of the movement of the user as in operation 440.

In operation 470, when the approval response is received, the hearing aid may perform the operation of the hearing aid that corresponds to the movement of the user. For example, according to the movement of the user, the hearing aid may perform operations such as mode change, full band gain control, gain control per frequency band, binaural hearing control, directivity control, connection control with respect to other devices, and parameter setting. In performing the respective operations, the hearing aid may determine detailed setting directions based on the movement of the user or input of a particular sound.

For example, during a full band gain control operation, a user may increase a gain of the full band of the hearing aid by performing a movement of lifting his or her head up while facing the front. On the other hand, the user may decrease the gain by performing a movement of lowering his or her head down while facing the front. The hearing aid may determine whether the user moves the head up or down based on the sensor data obtained from the sensor. Thus, the user may control the operation of the hearing aid intuitively through various movements.

Figure 5:
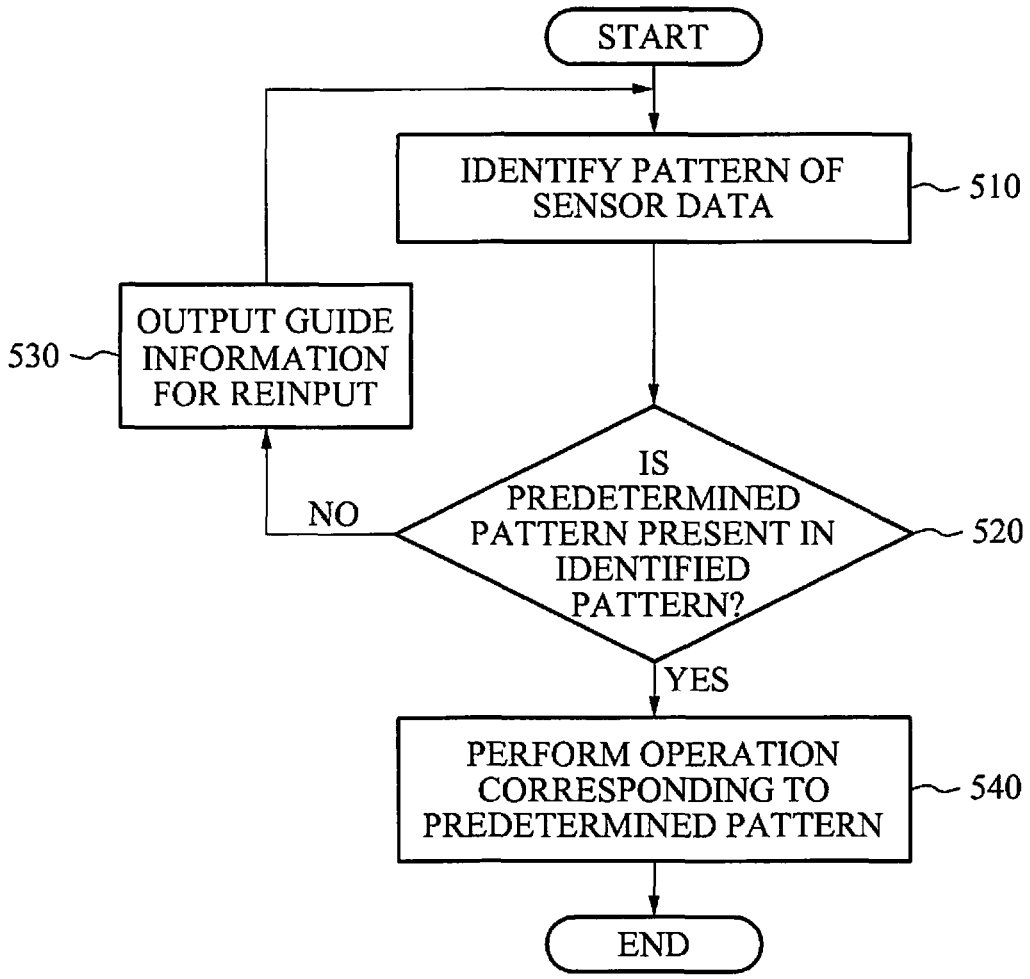
FIG. 5 is a flow chart illustrating another example of a method for controlling a hearing aid.

FIG. 5 illustrates another example of a method for controlling a hearing aid.

In operation 510, a hearing aid may obtain sensor data by detecting a movement of a user. After receiving a user input corresponding to a particular pattern through an interface, the hearing aid may activate the operation of the sensor. The hearing aid may output the sensor data by detecting the movement of the user from the time at which the user input is received. The user input may include a button press, a touch input, and a particular sound input. When the hearing aid receives the user input again or determines that a movement of the user is absent for a predetermined time after the sensor is activated, the hearing aid may stop the operation of the sensor.

The hearing aid may identify the pattern of the sensor data output by the sensor. The hearing aid may store the sensor data from a particular point in time, and identify the pattern of the sensor data indicating a temporal change of the sensor data, based on the stored sensor data. The hearing aid may determine the type of the movement of the user corresponding to the pattern of the sensor data, by identifying the pattern of the sensor data.

In operation 520, the hearing aid may determine whether a pattern identifier that corresponds to an identified pattern of the sensor data is present in the sensor data. The hearing aid may analyze the pattern of the sensor data, thereby determining whether a pattern identifier that corresponds to at least one of identified patterns of the sensor data is present. The hearing aid may determine whether a pattern identifier that is the same as or similar to a predetermined pattern is present in the pattern of the sensor data. For example, the hearing aid may calculate similarity between the pattern of the sensor data generated from the movement of the user and predetermined patterns indicated by the pattern identifiers, and determine a pattern identifier that corresponds to the pattern of the sensor data based on the similarity.

In operation 530, when the predetermined pattern that corresponding to the pattern of the sensor data is absent, the hearing aid may output guide information for re-input. For example, the hearing aid may output the guide information for re-input and guide information indicating that a pattern identifier that corresponds to the predetermined patterns has not been detected.

In operation 540, when a predetermined pattern corresponds to the pattern of the sensor data, the hearing aid may perform an operation that corresponds to the pattern identifier. For example, according to the pattern identifier, the hearing aid may perform operations such as mode change of the hearing aid, full band gain control, gain control per frequency band, binaural hearing control, directivity control, connection control with respect to other devices, and parameter setting.

Prior to performing the operation that corresponds to a pattern identifier, the hearing aid may output guide information related to the operation corresponding to the pattern identifier. For example, when the pattern of the sensor data corresponds to a pattern identifier, the hearing aid may output the guide information indicating the operation corresponding to the pattern identifier through the interface. For example, the hearing aid may output the guide information through a speaker of the hearing aid or display the guide information on a remote control of the hearing aid.

The guide information may include inquiry information for inquiring whether to perform the operation. The user may indicate the user's approval or disapproval to perform the operation by making a particular movement or particular sound. The hearing aid may determine a user intention based on the particular movement or particular sound, and determine whether to perform the operation.

When the audio signal detects a movement of the user or a particular sound that corresponds to a command to end of the operation, the hearing aid may end the operation that is being performed.

Figure 6:
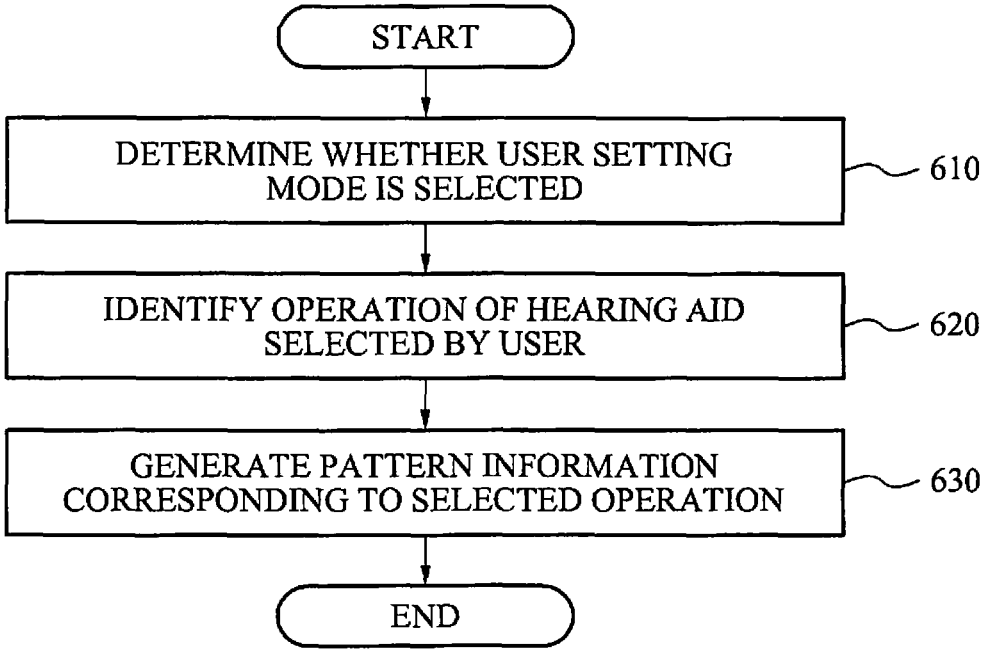
FIG. 6 is a flow chart illustrating an example of a method for controlling a hearing aid during a user setting mode.

FIG. 6 illustrates an example of a method for controlling a hearing aid during a user setting mode.

In operation 610, the hearing aid may determine whether the user setting mode is selected. For example, the hearing aid may determine whether the user setting mode is selected by detecting a particular movement of a user or a sound of a particular pattern, the movement or the sound corresponding to the initiation of the user setting mode. As another example, the hearing aid may determine whether the user setting mode is selected by detecting a remote control manipulation by the user.

The user may directly set a movement pattern corresponding to a particular operation of the hearing aid through the user setting mode. While the hearing aid is in the user setting mode, the user may revise or delete pattern information of a pattern identifier stored previously. For example, the user may replace a pattern of sensor data stored in a particular pattern identifier with a newly input movement pattern.

When the user setting mode is selected, the hearing aid may identify the operation selected by the user in operation 620. For example, the user may select the operation of the hearing aid, of which a pattern is to be newly set, using the remote control and therefore the hearing aid may identify the operation selected by the user. As another example, the hearing aid may output guide information related to operations of the hearing aid in sequence through a speaker. The user may select an operation of the hearing aid to be newly set, using a particular movement or sound or the remote control. The hearing aid may identify the operation selected by the user based on the user input including the movement of the user, the sound generated by the user, and the user manipulation of the remote control.

In operation 630, the hearing aid may generate pattern information corresponding to the operation selected by the user. When the user selects an operation to be newly set, the user may directly input a movement corresponding to the selected operation. The hearing aid may identify the pattern of the sensor data corresponding to the movement input by the user, and generate the identified pattern of the sensor data as pattern information corresponding to the operation selected by the user. The hearing aid may store the pattern information by matching the pattern information with the pattern identifier corresponding to the operation of the hearing aid selected by the user.

According to another example, while the hearing aid is in the user setting mode, the user may input a movement first and select the operation of the hearing aid corresponding to the input movement subsequent to inputting the movement. The hearing aid may identify the pattern of the sensor data corresponding to the input movement, and match the pattern of the sensor data with the operation selected by the user. The hearing aid may store matching information between the pattern of the sensor data and the operation of the hearing aid as a new pattern identifier name.

Various examples of hearing aids and methods of controlling hearing aids are described herein. In one example, there is provided a hearing aid including a sensor configured to detect a movement of a user and output sensor data, a pattern identifying unit configured to identify a pattern of the sensor data, and a control unit configured to determine whether a pattern identifier corresponding to the pattern of the sensor data is present and to control operation of the hearing aid based on the determination result.

The control unit may be configured to perform an operation of the hearing aid, the operation corresponding to the pattern identifier, when the pattern identifier corresponding to the pattern of the sensor data is present.

The operation of the user may include at least one of mode change, full band gain control, gain control per frequency band, binaural hearing control, directivity control, connection control with respect to other devices, and parameter setting.

In another example, there is provided a method of controlling a hearing aid, the method including outputting sensor data by detecting a movement of a user, determining whether a pattern identifier corresponding to a pattern of the sensor data is present, and controlling operation of the hearing aid based on the determination result.

The method may further include determining whether a user setting mode is selected, receiving a user input corresponding to a particular pattern through an interface, and generating pattern information corresponding to the selected operation of the hearing aid based on the movement of the user.

The method may further include identifying an operation of the hearing aid selected by the user when the user setting mode is selected, and outputting sensor data by detecting the movement of the user from a time point at which the user input is received.

The above-described examples of methods of controlling a hearing aid may be recorded, stored, or fixed in one or more non-transitory computer-readable media that includes program instructions to be implemented by a computer to cause a processor to execute or perform the program instructions. The media may also include, alone or in combination with the program instructions, data files, data structures, and the like. The program instructions recorded on the media may be those specially designed and constructed, or they may be of the kind well-known and available to those having skill in the computer software arts. Examples of non-transitory computer-readable media include magnetic media such as hard disks, floppy disks, and magnetic tape; optical media such as CD ROM disks and DVDs; magneto-optical media such as optical discs; and hardware devices that are specially configured to store and perform program instructions, such as read-only memory (ROM), random access memory (RAM), flash memory, and the like. Examples of program instructions include both machine code, such as produced by a compiler, and files containing higher level code that may be executed by the computer using an interpreter. The described hardware devices may be configured to act as one or more software modules in order to perform the operations and methods described above, or vice versa.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A hearing aid comprising:

a sensor configured to obtain sensor data corresponding to a user movement;

a pattern identifying unit configured to identify a pattern in the sensor data; and a control unit configured to determine whether a pattern identifier is present or absent in the pattern of the sensor data and to control the hearing aid, wherein the control unit activates an operation of the sensor when a user input that corresponds to a particular pattern is input, and wherein the control unit stops the operation of the sensor when another user input is received or the user movement is absent for a predetermined time after the operation of the sensor is activated.

2. The hearing aid of claim 1, wherein, in response to a determination that a pattern identifier is present in the pattern of the sensor data, the control unit is configured to initiate an operation of the hearing aid that corresponds to the pattern identifier.

3. The hearing aid of claim 2, wherein the control unit is configured to confirm whether to perform the operation of the hearing aid that corresponds to the pattern identifier based on an input of another user movement.

4. The hearing aid of claim 2, wherein the operation of the hearing aid comprises at least one selected from the group consisting of mode change, full band gain control, gain control per frequency band, binaural hearing control, directivity control, connection control with other device, and parameter setting.

5. The hearing aid of claim 1, wherein the control unit is configured to activate the sensor to obtain the sensor data in response to receiving a user input through an interface.

6. The hearing aid of claim 5, wherein the user input comprises at least one selected from the group consisting of a button press, a touch input, and a sound input.

7. The hearing aid of claim 1, wherein the control unit is configured to output guide information indicating an operation corresponding to the pattern identifier in response to a determination that the patter identifier is present in the patter of the sensor data.

8. The hearing aid of claim 1, wherein the sensor data is movement data obtained from the sensor or from a motion sensor in a remote control of the hearing aid.

9. A hearing aid comprising:

a sensor configured to obtain sensor data corresponding to a user movement;

a pattern information storage unit configured to store predetermined patterns; and a control unit configured to determine presence or absence of a pattern identifier in the sensor data based on the predetermined patterns and to control the hearing aid, wherein the control unit activates an operation of the sensor when a user input that corresponds to a particular pattern is input, and wherein the control unit stops the operation of the sensor when another user input is received or the user movement is absent for a predetermined time after the operation of the sensor is activated.

10. The hearing aid of claim 9, wherein the control unit is configured to determine the presence or the absence of the pattern identifier by comparing a pattern of the sensor data to the predetermined patterns stored in the pattern information storage unit.

11. The hearing aid of claim 9, wherein the sensor is activated in response to an initial user input, and wherein, in response to a determination that a pattern identifier is absent, the control unit is further configured to output guide information for inputting another user movement to the sensor.

12. The hearing aid of claim 9, wherein, in response to a determination that a pattern identifier is present, the control unit is configured to initiate an operation of the hearing aid that corresponds to the pattern identifier.

13. A method for controlling a hearing aid, the method comprising:

obtaining, from a sensor of the hearing aid, sensor data by detecting a user movement;

determining whether a pattern identifier is present or absent in the sensor data; and controlling the hearing aid based on the presence or the absence of the pattern identifier, wherein the controlling comprises activating an operation of the sensor when a user input that corresponds to a particular pattern is input, and stopping the operation of the sensor when another user input is received or the user movement is absent for a predetermined time after the operation of the sensor is activated.

14. The method of claim 13, wherein the determining comprises determining the presence or the absence of the pattern identifier by comparing a pattern of the sensor data to predetermined patterns stored in a patter information storage unit.

15. The method of claim 13, wherein, in response to the patter identifier being present, the controlling comprises performing an operation of the hearing aid that corresponds to the pattern identifier.

16. The method of claim 13, wherein the obtaining comprises:

receiving a user input comprising a movement pattern through an interface; and outputting sensor data by detecting the user movement from a time at which the user input is received.

17. The method of claim 13, further comprising:

determining whether a user setting mode is selected;

identifying an operation of the hearing aid selected by the user when the user setting mode is selected; and generating pattern information corresponding to the selected operation of the hearing aid based on the user movement.

18. The method of claim 13, wherein the obtaining comprises:

receiving a user input through an interface; and outputting sensor data generated based on the user movement from a time at which the user input is received.

19. The method of claim 15, wherein the operation of the hearing aid comprises at least one selected from the group consisting of mode change, full band gain control, gain control per frequency band, binaural hearing control, directivity control, connection control with other device, and parameter setting.

20. The hearing aid of claim 9, wherein, in response to a determination that a pattern identifier is present, the control unit is further configured to require confirmation of the identified pattern.

* * * * *